United States Patent [19]

Pattermann

[11] 4,300,708

[45] Nov. 17, 1981

[54] DRYWALL TAPER'S TOOL CARRIER AND COMBINATIONS THEREWITH

[76] Inventor: Norbert C. Pattermann, 320 E. Alpine St., Altamonte Springs, Fla. 32701

[21] Appl. No.: 130,862

[22] Filed: Mar. 17, 1980

[51] Int. Cl.[3] ..... A45C 1/04

[52] U.S. Cl. ..... 224/253; 224/232; 224/904

[58] Field of Search ..... 224/253, 191, 224, 226, 224/232, 234, 250, 904, 911, 192, 252

[56] References Cited

U.S. PATENT DOCUMENTS

| | | | |
|---|---|---|---|
| 1,110,993 | 9/1914 | Sisson | 224/911 X |
| 1,504,927 | 8/1924 | Baust | 224/232 X |
| 2,236,382 | 3/1941 | Roberge | 224/253 X |
| 2,399,522 | 4/1946 | Tyson | 224/232 X |
| 3,307,756 | 3/1967 | Brunosson et al. | 224/232 |
| 3,343,735 | 9/1967 | Breeding et al. | 224/904 X |
| 4,044,932 | 8/1977 | Harris, Jr. | 224/253 X |

*Primary Examiner*—Steven M. Pollard
*Attorney, Agent, or Firm*—Roger L. Martin

[57] ABSTRACT

A carrier for a drywall taper's broad knife has a main pocket for the broad knife and an auxiliary pocket for a shear knife. The carrier includes three pocket wall forming components that are preferably made from leather. The opening at the upper end of the pocket is generally inclined and the arrangement is such that the handle of the broad knife comes to rest in a recessed upper edge portion at the upper end of one of the narrow side walls while the working edge of the knife blade confronts the opposite narrow side wall in the pocket structure.

1 Claim, 6 Drawing Figures

DRYWALL TAPER'S TOOL CARRIER AND COMBINATIONS THEREWITH

BACKGROUND OF THE INVENTION

This invention relates to a drywall taper's tool carrier and more particularly to tool carriers that are designed to receive a drywall taper's broad knife.

It is common practice for a worker involved in the taping and finishing of drywall to use various different types of knives to work the drywall compound into and around corners and elsewhere in the drywall structure. Among such tools are the so-called "broad knives" and the so-called "shear knives". The former is a sizable tool with a broad blade that frequently has a working edge that is as much as fourteen inches long while the common shear knife has a working edge that is usually less than half that of the worker's broad knife.

To facilitate the storage of the broad knife when it is not in use, as when the need arises for the worker to use the shear knife or otherwise take on some other task, the need exists for a suitable broad knife carrier which may be suspended from the worker's body. The need also exists for a body carrier for both the broad knife and the shear knife so that both of these tools are readily available to the worker when the need arises for their use.

SUMMARY OF THE INVENTION

The drywall taper's broad knife is a bulky tool to house or support on a carrier that is designed for suspension from a worker's body because the blade of the usual broad knife is not only better than a foot in width but the handle is so arranged that is projects laterally of the blade between its opposite ends and sometimes as much as five or six inches from the blade edge opposite the working edge of the tool.

To provide a carrier for this type of tool, the inventor provides a carrier or pocket with an opening that is adapted to receive one end of the broad knife blade and to thereafter house the blade in an arrangement such that the tool handle rests on the upper edge of a narrow side wall of the pocket while the working edge of the blade confronts a narrow side wall at the opposite side of the pocket. The use of pliant materials, such as leather, in the construction of the carrier is preferred even though the blade corners tend to dig into such material and sometime render it difficult to house the tool in the pocket because the pliant materials tend to retard unintended movement of the tools out of the pocket. To avoid obstructing the movement of the knife blade into the pocket, the pocket is provided with a pair of narrow opposite side walls that are arranged to straddle the opposite edges of the back wall forming component of the pocket and which are additionally formed from a pliant member that also serves to form the front wall of the pocket. The arrangement is such that the opening between the narrow opposite side walls inclines from one wall to the other and the handle of the broad knife rests at the upper end of one wall while the working edge of the blade is covered by the other narrow wall. The lower end portion of the broad knife pocket is also opened between the opposite edges straddled by the narrow side wall forming member. Here however the opening is provided for the purpose of permitting any debris that might enter the pocket to fall free of the pocket area and without accumulating at the interior of the pocket.

Certain aspects of the invention contemplate the provision of an auxiliary pocket for the worker's shear knife and here the front wall forming member for the broad knife pocket forms the back wall of the auxiliary pocket. The front wall of the auxiliary pocket for the shear knife, on the other hand, is formed by a component with opposite border portions that overlay the opposite marginal portions of the back wall forming component for the auxiliary pocket and these border portions and marginal portions are secured to the back face of the back wall forming component of the broad knife pocket. At the lower end of the auxiliary pocket the front and back wall forming pocket portions are fixed together by spaced apart rivets that provide openings between the rivets to facilitate the removal of any debris that inadvertently gets into the auxiliary pocket area.

In accord with certain aspects, provisions are made for securing a lower end portion of the carrier to the worker's leg while provisions are made at the upper end of the carrier to provide a cant to the carrier as it is suspended from the worker's body.

A general object of the invention is to provide a body carrier for a drywall taper's broad knife. Yet another object is to provide a broad knife carrier with certain safety features that are designed to protect the body of the worker from injury from the broad knife. Yet another object is to provide a broad knife carrier which utilizes pliant components in the formation of a receptacle or pocket for the broad knife and which is designed for easy insertion and retrieval of the tool by the worker. Yet another object is to provide a carrier of the kind contemplated and which is also adapted to house a second knife used by the worker. Other objectives of the invention are to provide an inexpensive carrier for a drywall taper's broad knife and which is inexpensive to manufacture and simple to use.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings and wherein:

Figure 1:
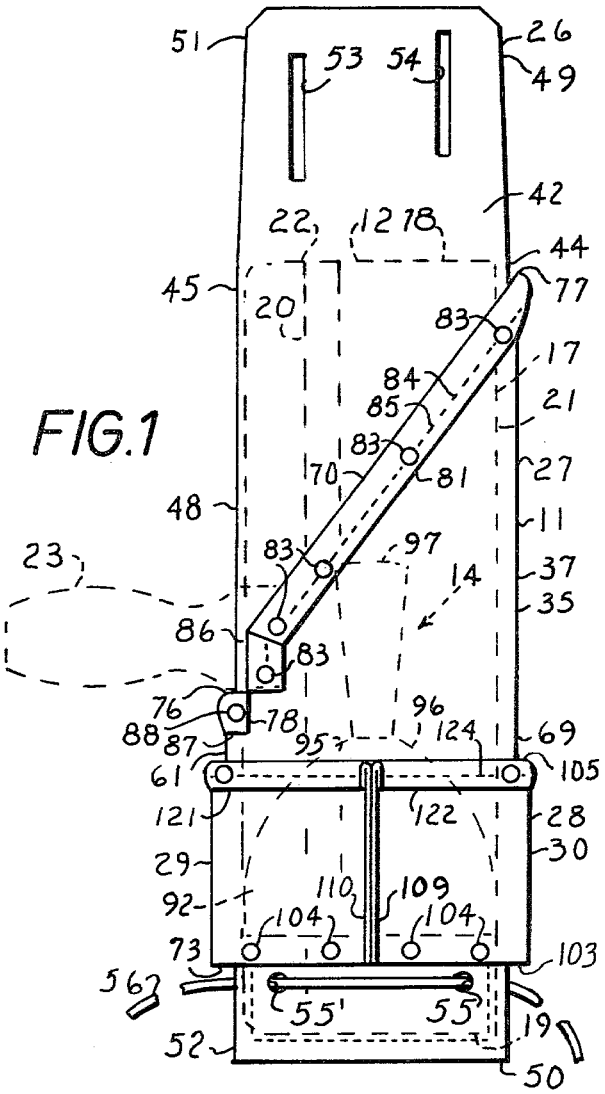
FIG. 1 is a front elevational view of a broad knife carrier embodying the principles of the invention and wherein certain parts are broken away and the trowels that are housed in the carrier are shown in broken lines.
Figure 4:
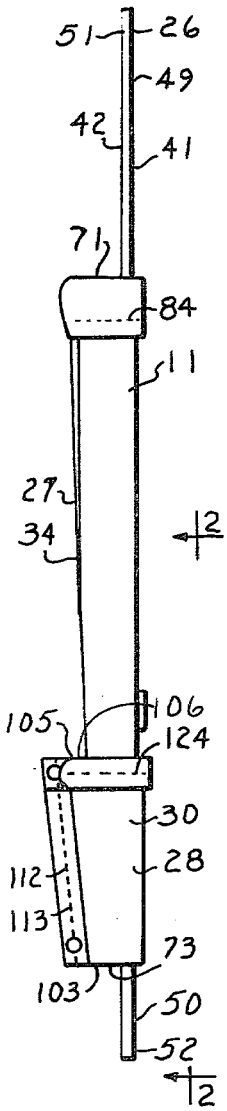
FIG. 4 is a side elevational view along the leading side of the carrier as seen in FIG. 1 with the trowels being removed.
Figure 3:
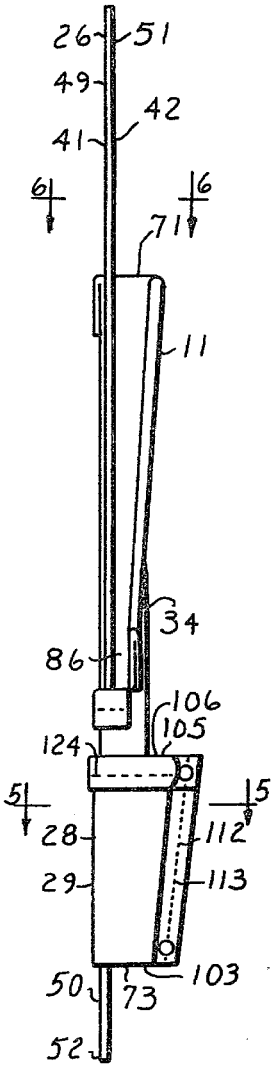
FIG. 3 is a side elevational view as seen at the trailing side of the carrier shown in FIG. 1 and with the trowels removed.
Figure 2:
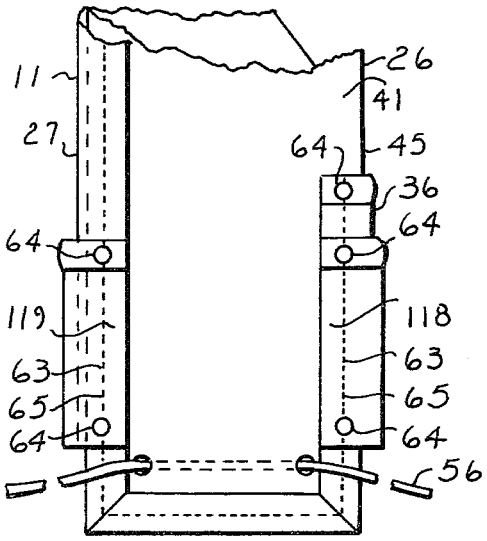
FIG. 2 is a fragment of a rear elevational view of the carrier as seen in FIG. 1 with certain parts broken away.
Figure 6:
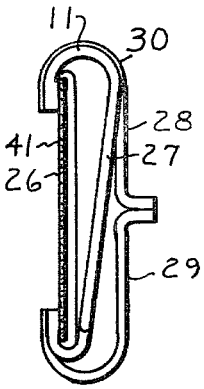
FIG. 6 is a horizontal sectional view taken generally along the Lines 6—6 of FIG. 3.
Figure 5:
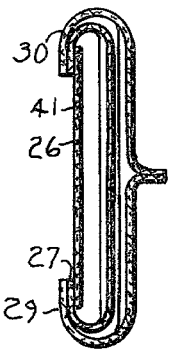
FIG. 5 is a horizontal sectional view taken generally along the Lines 5—5 of FIG. 3.

Reference is now made to the drawings and wherein a broad knife carrier embodying the principles of the invention is generally designated at 10. The carrier has a narrow, upright pocket 11 for receiving and housing the blade of a drywall taper's broad knife 12 and an auxiliary pocket 13 which is designed to receive and house the blade of a shear knife designated at 14.

The broad knife 12 has an elongated, flat and generally rectangular blade 17 which has opposite ends 18 and 19 at the opposite sides of the tool. Blade 17 also has opposite side edges 20 and 21 which extend between the opposite ends 18 and 19. Edge 21 serves as the working edge of the tool while at the opposite side edge 20, the blade 17 is fixed to an elongated holder 22 which straddles the side edge 20 and is equipped with an elongated handle 23. Handle 23 is located between the opposite ends 18 and 19 and extends laterally of the blade 17.

The main pocket 11 for the broad knife 12 is basically formed from two pliant components or members that are designated at 26 and 27. The auxiliary pocket for the shear knife 14, on the other hand, is basically formed from pliant component 27 and yet another pliable component which is designated at 28. Component 28 is made from two flat, generally rectangular pliable members which are designated at 29 and 30 respectively.

The main pocket 11 has a back side wall 33 which normally confronts one of the sides of the user's body when the carrier is in use. The pocket 11 also has a front side wall 34 that facially confronts the back side wall in the assembled carrier. When the carrier is in use, side wall 34 is normally laterally offset from the user's body side and is so arranged that the back side wall 33 is located between it and the user's body side. Apart from walls 33 and 34, pocket 11 has a pair of narrow, upright and laterally spaced apart walls 35 and 36. As the carrier is normally suspended from the worker's body, these narrow side walls 35 and 36 are respectively located at the leading and trailing sides 37 and 38 of the carrier.

The back side wall 33 of the main pocket 11 is formed by a flat pliant component 26 that is preferably made of tanned leather or other suitably pliable material. This component 26 is elongated and more or less rectangular in shape. When the assembled carrier is suspended from the worker's body, component 26 is vertically oriented and normally so arranged that the back face 41 faces the body side of the worker. On the other hand, the front face 42 more or less faces the interior 43 of the pocket. These faces 41 and 42 extend between the opposite side edges 44 and 45 of the pliant component 26 and as the carrier 10 is normally worn by a worker, the edges 44 and 45 are respectively located at the leading and trailing sides 37 and 38 of the carrier 10.

Component 26 is made from a single, flat, pliant leather member so as to avoid blade catching obstructions to the movement of the broad knife blade into the pocket opening as it is inserted in pocket 11. The back side wall 33 of the pocket 11 is formed by an intermediate portion 48 of the component 26. Portion 48 extends between the opposite end portions 49 and 50 of the component 26 and these end portions are respectively located at the upper and lower ends 51 and 52 of the carrier as normally suspended from the worker's body. Provisions are made in the upper end portion 49 of component 26 for suspending the carrier from the worker's body in the form of a pair of laterally spaced apart slots 53 and 54 for receiving the worker's body belt. These slots 53 and 54 are vertically offset with the upper extremity of the leading slot 54 being higher than the upper extremity of the trailing slot 53 so as to provide a forwardly inclined cant to the carrier that facilitates the insertion and retrieval of the tool from the pocket. The lower end portion 50 of component 26, on the other hand, has a pair of spaced apart holes 55 for receiving a rawhide length 56 or other elongated flexible element that may be used for securing the lower end of the carrier to the worker's leg.

Pliant member 27 is a flat, leather component which is vertically oriented in the suspended carrier 10. It has a pair of elonagated, narrow and laterally spaced apart marginal portions 61 and 62 that form the narrow trailing and leading side walls 36 and 35 of pocket 11. Extending between these marginal portions 61 and 62 is an intermediate portion 69 of component 27. This intermediate portion 69 forms the front side wall 34 of the pocket structure. In the assembled carrier, marginal portions 61 and 62 are arcuately rolled and arranged to straddle the trailing and leading side edges 45 and 44 of component 26. Here at the opposite side edges and along the back face 41 of the component 26, the marginal portions 61 and 62 are secured to the intermediate portion 48 by means of stitches 63 and rivets 64 along stitch lines 65 and 66.

The upper edge portion 70 of component 27 defines an upper or top opening 71 for receiving the broad knife blade 17 in the pocket 11 and which extends across the front face 42 of component 26. The lower edge portion 72 of component 27, on the other hand, defines a bottom opening that also extends across the front face of component 26. This bottom opening 73 serves as a discharge opening for debris that inadvertently gets into the pocket 11 and like the top opening 71, opening 73 extends between the spaced apart marginal portions 61 and 62 and the respective side edges 45 and 44 straddled thereby. This arrangement avoids blade catching obstructions to the movement of the blade through the top opening and avoids debris collecting structure at the bottom opening 73.

The upper edge portion 70 of component 27 has a pair of opposite side edge portions 76 and 77 that are located at the upper ends 78 and 79 are marginal portions 61 and 62. Between these side edge portions 76 and 77, the upper edge portion 70 has an intermediate edge portion 80 which inclines forwardly from the trailing marginal portion 61 to the leading marginal portion 62 of component 27. At the upper end of the pocket 11, and along the edge portions 80 and 87, component 27 has a flap 81 that is turned down and secured to the outside face 82 of component 27 by means of rivets 83 and stitches 84 along stitch line 85. This arrangement strengthens the pocket structure in the area of opening 71 and tends to avoid collapse of the front wall into the opening. The side edge portion 76 at the upper end of the trailing marginal portion 61, however, is located below the intermediate edge portion 80. As such, side edge portion 76 is downwardly offset from the intermediate edge portion 80 and provides a recessed upper edge portion that accomodates and supports the handle 23 of the broad knife 12 when the blade 17 is received in the pocket 11. To strengthen the recessed edge portion 76, the upper end of member 27 is provided with another flap 87 which again is turned down to overlap the outside face 82 of component 27 and thereat secured by means of rivets 88 and stitches 89 as along stitch line 90.

The shear knife 14 has a more or less triangular blade 93 with a working edge that is designated at 94. The opposite sides 95 and 96 of the blade 93 are generally arcuate and converge upon an elongated handle 97 that generally lies in the plane of the blade and extends laterally thereof as generally seen in the drawings.

The auxiliary pocket has a rear side wall 101 and a front side wall 102 which are respectively formed by the flat pliant member 27 and the pliable component 28. Member 27 and component 28 are secured together at the back face 41 of component 26 and are also secured together at the lower end 103 of pocket 13 as by means of spaced apart rivets designated at 104. At the upper end 105 of the pocket 13, the pocket has an opening 106 for inserting and retrieving the shear knife into and from the pocket 13.

The front and side wall forming component 28 for the auxiliary pocket 13 is made up of a pair of pliable, and generally rectangular members 29 and 30. These members 29 and 30 have elongated and narrow marginal portions 109 and 110 that are secured together in a face-to-face relation at the center of the component 28 by means of rivets 111 and stitches 112 along stitch line 113. This forms a front wall strengthening rib or medial portion that projects outwardly of the pocket between the upper and lower end portions 115 and 116 of component 28. At the opposite sides of the component 28, the component is provided with a pair of narrow, upright border portions 118 and 119. These border portions 118 and 119 are spaced apart and arranged to overlay the marginal portions 61 and 62 at the back face 41 of component 26 in the assembled carrier. Here, the border portions 118 and 119 are secured to component 26 and member 27 by means of the stitches 63 and rivets 64 along stitch lines 65 and 66. The intermediate portion 120 of component 28 extends between the border portions 118 and 119 and intermediate the opposite side border portions 118 and 119 is provided with a rib forming medial portion 114.

Each member 29 and 30 of component 28 is provided at the upper end 105 of the pocket with an edge flap 121 and 122 which is turned down to overlay the outside face 123 of component 28 and secured by stitches 124 along stitch lines 125 to add rigidity to the upper end portion of component 28 and avoid collapse to the pocket walls into the opening 106. At the bottom of the auxiliary pocket 13, the rivets 104 are spaced apart so that a screwdriver or other similar element may be passed through the openings between the rivets so as to dislodge any debris that might inadvertently collect at the bottom end of the pocket.

While only a certain preferred embodiment of this invention has been shown and described by way of illustration, many modifications will occur to those skilled in the art and it is, therefore, desired that it be understood that it is intended herein to cover all such modifications that fall within the true spirit and scope of this invention.

What is claimed as new and what it is desired to secured by Letters Patent of the United States is:

1. A body carrier for a drywall taper's broad knife which has an elongated flat blade with opposite ends, and opposite side edges that extend between said opposite ends, and an elongated handle that is fixed to the blade between said opposite ends and extends laterally thereof at one of said opposite side edges, said carrier having a narrow pocket for housing said blade which has a leading side and a trailing side and includes a back side wall that normally confronts a side of the carrier user's body, a front side wall that is normally laterally offset from the user's body side and facially confronts said back side wall therebetween, and a pair of elongated narrow side walls that are spaced apart and respectively interconnect the back and front side walls at the leading and trailing sides of said pocket, and means for suspending the pocket from the user's body, said carrier comprising an elongated and vertically oriented, flat, pliant component which forms said back side wall and has a leading side edge, a trailing side edge, a back face that extends between the leading and trailing side edges of said pliant component and normally faces the carrier user's body side, and a front face that extends between the leading and trailing side edges of said pliant component and faces the interior of the pocket, and a vertically oriented, flat, pliant member which has a pair of elongated, narrow and laterally spaced apart marginal portions that respectively form said narrow side walls and are arcuately rolled and arranged to respectively straddle the leading and trailing side edges of said flat pliant component, and an intermediate portion which extends between said marginal portions and forms said front wall, and means securing the marginal portions in facial contact with the back face of said pliant component and along the respective leading and trailing side edges straddled thereby, said pliant member having an upper edge portion which defines a top opening in the pocket for receiving the blade of the broad knife, and a lower edge portion which defines a bottom opening in the pocket, each of the top and bottom openings in said pocket extending between said spaced apart marginal portions and the leading and trailing side edges straddled thereby, and said upper edge portion having an intermediate edge portion that inclines from the marginal portion at the trailing side of said pocket, and a side edge portion which is located below said intermediate edge portion and at the upper end of the marginal portion at the trailing side of said pocket to provide an edge recess that accomodates the handle that is fixed to a broad knife blade housed in said pocket, said body carrier also having an auxiliary pocket for a shear knife, said auxiliary pocket having a rear side wall, and a front side wall, said rear side wall of the auxiliary pocket being formed by said vertically oriented flat, pliant member, said carrier comprising a pliable component which forms the front side wall of the auxiliary pocket and has a pair of elongated, narrow and laterally spaced apart border portions that overlay and are fixed to the respective marginal portions of said pliant member at the back face of the back side wall forming pliant component, and an intermediate portion which extends between said border portions, said pliable component having an upper end portion which defines an upper opening in the auxiliary pocket, and a lower end portion, and said intermediate portion of said pliable component having a medial portion which projects outwardly of the front side wall of the auxiliary pocket and forms a vertically extending wall strengthening rib that extends between the upper and lower end portions of said pliable component, and spaced apart means securing said pliable component along its lower end portion to said pliant member and providing bottom openings between the securing means for the withdrawal of debris from said auxiliary pocket.

* * * * *